United States Patent [19]

Berchem et al.

[11] Patent Number: 4,711,503

[45] Date of Patent: Dec. 8, 1987

[54] REPLACEABLE TOOTH FOR A DIGGING AND BREAKING TOOL

[75] Inventors: Rütger Berchem, Gelsenkirchen; Georg Prokscha, Recklinghausen, both of Fed. Rep. of Germany

[73] Assignee: Berchem & Schaberg GmbH, Gelsenkirchen, Fed. Rep. of Germany

[21] Appl. No.: 901,269

[22] Filed: Aug. 27, 1986

[30] Foreign Application Priority Data

Sep. 6, 1985 [DE] Fed. Rep. of Germany ..... 3531787

[51] Int. Cl.[4] ..... E21C 35/18; E02F 9/28; A01B 23/02

[52] U.S. Cl. ..... 299/79; 37/142 R; 172/719

[58] Field of Search ..... 299/79, 89, 91, 93; 175/410, 411, 374, 409; 37/142 R, 141 T; 172/719

[56] References Cited

U.S. PATENT DOCUMENTS

| | | | |
|---|---|---|---|
| 1,835,701 | 12/1931 | Edmunds | 175/411 |
| 2,673,716 | 3/1954 | Avery | 175/411 |
| 2,756,023 | 7/1956 | Bessler | 175/411 |
| 3,268,259 | 8/1966 | Snipe | 299/91 |
| 3,790,353 | 2/1974 | Jackson et al. | 37/141 T |
| 3,805,423 | 4/1974 | Engel et al. | 175/410 X |
| 3,888,637 | 6/1975 | Taguchi et al. | 37/142 R |
| 4,319,415 | 3/1982 | Mayerbock et al. | 37/67 |
| 4,488,608 | 12/1984 | Berchem | 175/374 |
| 4,582,364 | 4/1986 | deMay | 299/91 X |

FOREIGN PATENT DOCUMENTS

| | | | |
|---|---|---|---|
| 1528599 | 5/1968 | France | 299/79 |

*Primary Examiner*—Stephen J. Novosad
*Assistant Examiner*—David J. Bagnell
*Attorney, Agent, or Firm*—Karl F. Ross; Herbert Dubno

[57] ABSTRACT

A replaceable tooth article is disclosed for a digging and breaking tool used in a suction head of an excavator consisting of an adapter and a replaceable tooth having a pyramidal outer shape modified with a rounded apex and a plurality of rounded edges. The replaceable tooth is provided with a core composed of a low alloy, temperable and hardenable steel. A tooth peak of hard metal is mounted on the core. The edges of the core extending from the tooth peak are at least partially bevelled. On the bevelled surfaces formed thereby a plurality of edge elements composed of a hard metal, advantageously a carbide metal, are placed so as to form hard metal reinforced edges. All components of the tooth are joined together in a smooth surface.

5 Claims, 4 Drawing Figures

REPLACEABLE TOOTH FOR A DIGGING AND BREAKING TOOL

CROSS REFERENCE TO RELATED APPLICATION

This application is related to the commonly assigned U.S. patent application, Ser. No. 413,233 filed Aug. 31, 1982 issued as U.S. Pat. No. 4,488,608 on Dec. 18, 1984.

FIELD OF THE INVENTION

Our present invention relates to a replaceable tooth for a digging and breaking tool especially an excavator head and, more particularly, for a suction head of a dredge type excavator.

BACKGROUND OF THE INVENTION

U.S. Pat. No. 4,488,608 describes a replaceable tooth article for a digging and breaking tool consisting of an adapter and the tooth. The article is used in a suction head of an excavator and can have a pyramidal outer shape modified with a rounded apex and a plurality of rounded edges. The replaceable tooth has a core composed of a low alloy, temperable and hardenable steel and is provided with a hard metal reinforcement (see also German Patent No. 31 36 077).

The tooth apex is provided with a hard metal, e.g. tungsten carbide, reinforcement constructed as a spike with a rounded tip and inserted in a cavity in the end of the core. Such a tooth is very sensitive to nonuniform tool engagement or operation.

The sides of the tooth, at least in the vicinity of the peak, are subjected to extensive wear. This also contributes to hard metal spike break off.

OBJECTS OF THE INVENTION

It is an object of our invention to provide an improved replaceable tooth for a digging and breaking tool, especially a digging and breaking tool of a dredger which overcomes drawbacks of earlier replaceable tooth designs.

It is also an object of our invention to provide an improved replaceable tooth for a digging and breaking tool of a dredger in which the apex or "point" region of the replaceable tooth is more resistant to wear and stress, especially notch impact stress.

SUMMARY OF THE INVENTION

These objects and others which will become more readily apparent hereinafter are attained in accordance with our invention in a replaceable tooth article for a digging and breaking tool consisting of an adapter and the replaceable tooth and used in a suction head of an excavator with a pyramidal outer shape modified with a rounded apex and a plurality of rounded edges. The replaceable tooth is provided with a core composed of a low alloy, temperable and hardenable steel and with a hard metal (e.g. tungsten carbide) reinforcement.

According to our invention a tooth peak in the form of a separate piece is mounted on the core, the tooth peak has a pyramidal shape and the outer shape of the tooth is such that the edges of the core extending from the tooth peak are at least partially bevelled. On the bevelled surfaces formed thereby a plurality of edge elements composed of hard metal are placed and the core, the tooth peak and the edge elements are joined together in a smooth surface, i.e. at their abutting edges, these elements are flush with one another.

The core is made from a standard material used for making teeth for dredgers such as forging or casting steel. Hence the tooth in the adapter has mechanical properties in regard to elongation and impact stress sensitivity which are comparable to those of the earlier tool.

For the tooth peak, a hard metal, for example a metal carbide, is used. Because of the great strength of this material the tooth has an extraordinary wear resistance, although its elongation and toughness values are low.

Advantageously the tooth peak is provided with a central stud which engages in a recess in the core. The edge elements which adjoin the tooth peak are likewise made from hard metal (e.g. tungsten carbide) and play an essential role in the protection of the tooth peak. The reinforcement of the edges of the tooth or core by the edge elements of hard metal prevents material from wearing away under the tooth peak.

The hard metal reinforcement acts as a cutting edge and protects the less wear resistant material of the core from wearing away by abrasion. It is particularly advantageous when the hard metal reinforced edges are formed by joining edge elements each of which are approximately 40 mm in length and 14 mm in width.

The tooth according to our invention is particularly well suited for a tool for dredging under water. The advantages of the invention are that the tooth is extraordinarily wear resistant and that it can take pulsating stress, for example due to the motion of the sea and differences in the shape of the bottom.

BRIEF DESCRIPTION OF THE DRAWING

The above and other objects, features and advantages of our invention will become more readily apparent from the following specific description, reference being made to the accompanying highly diagrammatic drawing in which.

DESCRIPTION

Figure 1:
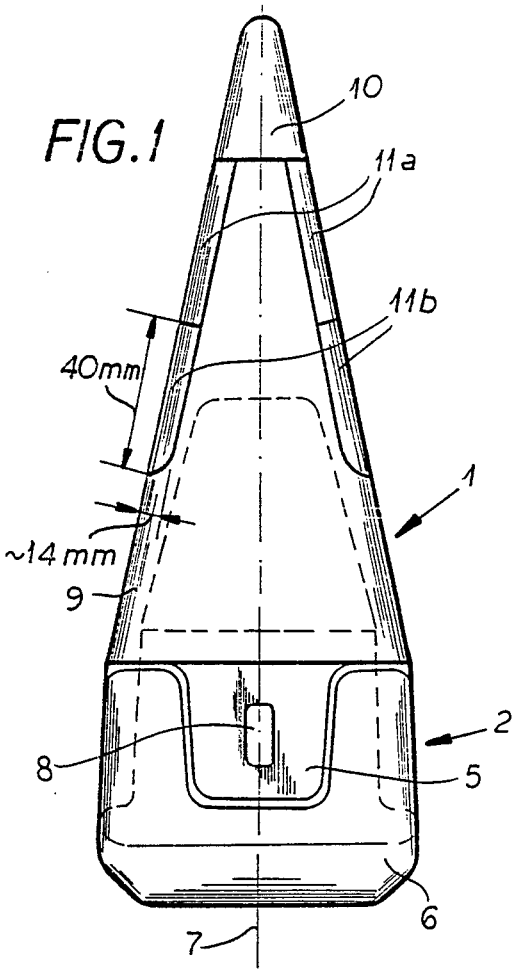
FIG. 1 is a side elevational view of a digging and breaking tool including an adapter and a replaceable tooth according to our invention.
Figure 3:
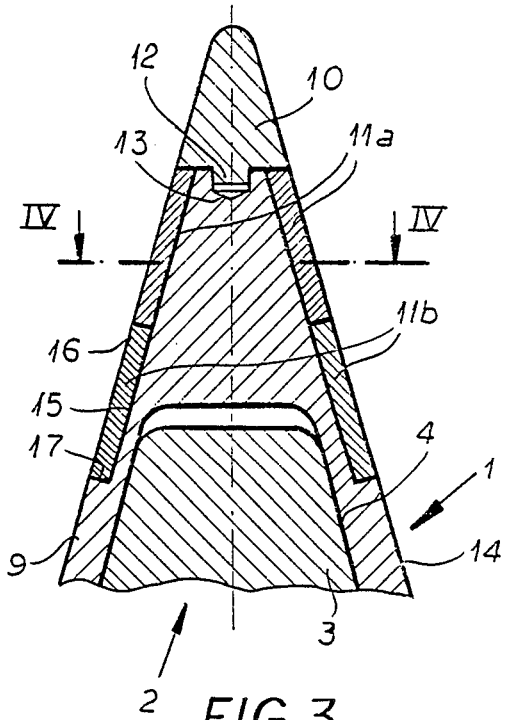
FIG. 3 is an axial cross sectional view through the digging and breaking tooth taken along the section line III—III of FIG. 2.
Figure 2:
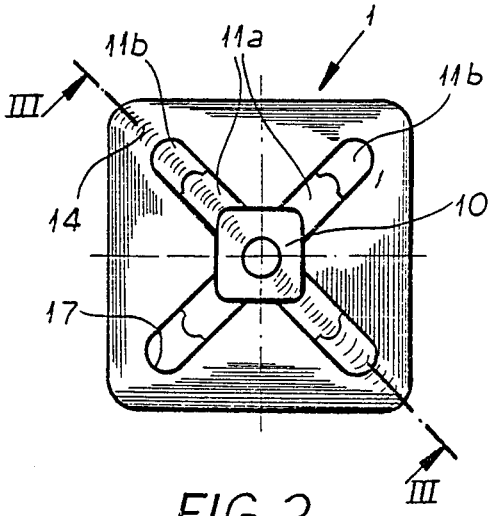
FIG. 2 is an end view of the replaceable tooth of FIG. 1.
Figure 4:
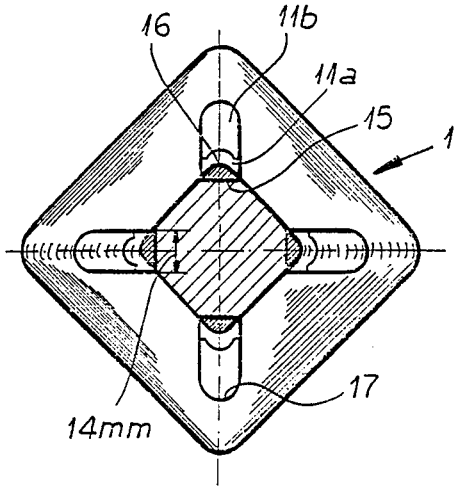
FIG. 4 is a cross sectional view through the replaceable tooth according to our invention taken along the section line IV—IV of FIG. 3.

The tooth for digging and breaking shown in the drawing is designed for the suction head of a dredger or more generally an excavator. The suction head carries a plurality of these teeth which are attached generally to an excavator head by welding.

Each tool comprises a tooth 1 and an adapter 2 welded to an excavator head (not shown in drawing). The adapter 2 has an externally conical shape adapter head 3.

The tooth 1 has a substantially pyramidal shape with a rounded tooth peak 10 and rounded edges and has an internally conical receptacle 4 receiving the adapter head 3.

The tooth 1 and the adapter 2 are provided near the tooth roots 5 and/or near the adapter foot 6 with passages associated with each other running perpendicular to the tool axis 7 and are attached to each other by a key or wedge 8.

The tooth 1 comprises a core 9, which is made from a low alloy, temperable and hardenable steel, a tooth peak 10 from a hard metal and edge elements 11*a* and 11*b* made from hard metal. The tooth peak 10 has a central stud 12 which engages in a recess 13 of the core 9. The edges 14 of the core 9 extending from the tooth peak 10 are bevelled. The edge elements 11*a* and 11*b* have a triangular cross section and flat surfaces 15 which match those of the bevels of the edges 14.

The length of the flat surfaces 15 is adjusted according to wear and tear experienced in using the tool and may be easily determined by trial and error. In this embodiment the hard metal reinforced edges 16 are formed by abutting ends of edge elements 11*a* and 11*b* which are each aproximately 40 mm long and 14 mm wide. A rounding off 17 results from a mechanical operation, for example by cutting or milling. The individual components of the tooth 1 and the core 9, the tooth peak 10 and the edge elements 11*a* and 11*b* and are joined so that a smooth surface results, i.e. are flush with one another.

The core 9 is made from a standard material used for manufacturing teeth for dredgers and/or excavators such as forged steel or cast steel. A steel of Mn-Cr-Mo-Ni quality with an approximate analysis (by weight) of 0.7–1.0% Mn,
0.7–2.2% Cr,
0.3–0.6% Mo,
0.5–2.2% Ni,
with a maximum of 0.45% C,
the balance being iron, which is tempered to a strength of 140 to 200 kp/mm$^2$ with an elongation of over 6% is particularly suitable.

Advantageously the hard metal referred to in this application is a metal carbide, i.e. tungsten carbide. The hard metal members 10, 11*a*, 11*b*, can be bonded to the core 9 by any conventional fusion technique.

We claim:

1. In a replaceable tooth article for a digging and breaking tool used in a suction head of an excavator consisting of an adapter and a replaceable tooth positioned over said adapter, said replaceable tooth having a pyramidal outer shape modified with a rounded apex and a plurality of rounded edges, said replaceable tooth being provided with a core composed of a low alloy, temperable and hardenable steel, the improvement wherein a hard metal rounded tooth peak is mounted on said core, said tooth peak partially defining said pyramidal shape and having a central stud protruding from a base of said peak engaging in a recess of said core, said core having edges extending from said tooth peak which are at least partially bevelled, and on the bevelled surfaces formed thereby a plurality of edge elements for each edge composed of hard metal are placed therein and said core, said tooth peak and said edge elements of said hard metal are joined together to abut one another to form a continuous surface.

2. The improvement according to claim 1 wherein each of said hard metal reinforced edges is approximately 40 mm in length and 14 mm in width.

3. The improvement according to claim 1 wherein said hard metal is a metal carbide.

4. A replaceable tooth article for a digging and breaking tool used in a suction head of an excavator consisting of an adapter and a replaceable tooth positioned over said adapter comprising:

a core composed of low alloy, temperable and hardenable steel having a truncated pyramidal outer shape and a plurality of rounded edges;

a rounded tooth peak of hard metal mounted on said core and having a central stud protruding from a base of said peak engaging in a recess in said core, said peak having a pyramidal shape modified with a rounded apex, the outer shape of said tooth being such that said edges of said core extend from said tooth peak and are at least partially bevelled; and a plurality of edge elements for each edge composed of hard metal placed on the bevelled surfaces formed therein and said core, said tooth peak and said edge elements of said hard metal are joined together in a smooth surface.

5. The improvement according to claim 4 wherein said hard metal is a metal carbide.

* * * * *